US010549970B2

(12) United States Patent
Puszkiewicz et al.

(10) Patent No.: US 10,549,970 B2
(45) Date of Patent: Feb. 4, 2020

(54) TELEHANDLER WITH CANTILEVER BOOM MOUNTING

(71) Applicant: JLG Industries, Inc., McConnellsburg, PA (US)

(72) Inventors: Ignacy Puszkiewicz, Hagerstown, MD (US); Robert S. Messina, Oshkosh, WI (US)

(73) Assignee: JLG INDUSTRIES, INC., McConnellsburg, PA (US)

( * ) Notice: Subject to any disclaimer, the term of this patent is extended or adjusted under 35 U.S.C. 154(b) by 52 days.

(21) Appl. No.: 15/666,977

(22) Filed: Aug. 2, 2017

(65) Prior Publication Data

US 2019/0039868 A1 Feb. 7, 2019

(51) Int. Cl.

| | |
|---|---|
| ***B66F 9/06*** | (2006.01) |
| ***B66F 9/065*** | (2006.01) |
| ***B66F 9/075*** | (2006.01) |
| ***B66F 17/00*** | (2006.01) |

(52) U.S. Cl.

CPC ..... *B66F 9/0655* (2013.01); *B66F 9/075* (2013.01); *B66F 9/0755* (2013.01); *B66F 9/07513* (2013.01); *B66F 17/003* (2013.01)

(58) Field of Classification Search

CPC .... B66F 9/0655; B66F 9/075; B66F 9/07513; B66F 9/0755; B66F 17/033; B66C 23/36

See application file for complete search history.

(56) References Cited

U.S. PATENT DOCUMENTS

| | | | | |
|---|---|---|---|---|
| 4,042,135 | A * | 8/1977 | Pugh | B66F 9/0655 212/278 |
| 4,135,597 | A * | 1/1979 | Barth | B62D 12/00 180/41 |
| 4,744,718 | A | 5/1988 | Logan et al. | |
| 4,964,780 | A | 10/1990 | Karvonen | |
| D460,085 | S | 7/2002 | Crookes et al. | |
| 6,910,544 | B2 | 6/2005 | Sewell | |
| 8,775,034 | B2 | 7/2014 | Hyodo et al. | |
| 8,965,571 | B2 | 2/2015 | Peters et al. | |
| 9,139,409 | B2 | 9/2015 | Perron | |
| 9,434,412 | B2 | 9/2016 | Clark et al. | |
| 9,592,733 | B2 | 3/2017 | Lyle et al. | |
| 2002/0006325 | A1 | 1/2002 | Granroth et al. | |
| 2009/0206589 | A1 * | 8/2009 | Osswald | B62D 21/14 280/782 |

(Continued)

FOREIGN PATENT DOCUMENTS

| | | | | |
|---|---|---|---|---|
| DE | 3800930 | * | 8/1989 | B66C 23/36 |
| DE | 196 45 651 | | 6/1998 | |

(Continued)

OTHER PUBLICATIONS

European Extended Search Report dated Dec. 4, 2018 issued in European Patent Application No. 18185712.9, 10 pp.

*Primary Examiner* — Ronald P Jarrett
(74) *Attorney, Agent, or Firm* — Nixon & Vanderhye P.C.

(57) ABSTRACT

A telehandler includes a fixed or articulated frame having a front frame segment and a rear frame segment separated by a connecting point. A cantilever support extends from a fixing point on the front frame segment aft beyond the connecting point to a boom support adjacent a distal end. A boom is pivotably secured at a boom pivot to the boom support.

22 Claims, 9 Drawing Sheets

(56) References Cited

U.S. PATENT DOCUMENTS

| | | | | |
|---|---|---|---|---|
| 2014/0277697 | A1 | 9/2014 | McDonald et al. | |
| 2017/0036894 | A1* | 2/2017 | Braun | B66C 23/905 |
| 2018/0327238 | A1* | 11/2018 | Tremblay | B66F 9/0755 |

FOREIGN PATENT DOCUMENTS

| | | |
|---|---|---|
| FR | 2 990 202 | 11/2013 |
| JP | 6-45989 | 2/1994 |
| WO | WO 2006/086569 | 8/2006 |

* cited by examiner

TELEHANDLER WITH CANTILEVER BOOM MOUNTING

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND

The invention relates to a telescoping boom materials handler, i.e., a telehandler and, more particularly, to a telehandler incorporating a cantilever boom mounting providing an extended reach and added functionality and maneuverability.

Existing high-capacity and ultra-high-capacity telehandlers utilize a fixed frame design with four steerable wheels. The use of large diameter, wide tires limits the space available for the wheels to turn (unless the machine is made excessively wide), resulting in limited steering angles. As a consequence, typical machines of this type have large turning radii, making the machines less maneuverable.

Existing machines with traditional four-wheel steering lack the ability to correct a position of the load in use. If an operator approaches the landing place for the load at the wrong angle, the operator is required to back up the machine to correct its location and orientation and re-approach the landing.

Known articulated telehandlers typically have a short boom mounted in front of the operator cab. The boom pivot pin is positioned in front of the central articulated joint. These machines thus have better steering capabilities but limited reach and functionality. Moreover, articulated telehandlers (and articulated wheel loaders) have variable stability ratings when the frame is in a straight position versus when the frame is in an articulated (steered) position. Existing articulated machines thus typically require a shorter boom to prevent the machine from becoming unstable when carrying a load and rely on operator judgment to establish if the machine can be steered when loaded with the boom extended and/or elevated.

BRIEF SUMMARY

The telehandler of the described embodiments incorporates a cantilever boom mounting that provides for a fixed frame or articulated frame telehandler with an extended reach boom. The cantilever boom mounting in the fixed frame machine additionally provides for improved service access (for installation, maintenance and service), when compared to typical telehandlers with in-line powertrain layouts. An integrated control and stability management system in the articulated frame machine may provide for improved stability characteristics.

In an exemplary embodiment, a telehandler includes a frame supporting an operator cab, a pair of front wheels and a pair of rear wheels coupled with the frame, and a cantilever support secured at a fixing point to the frame. The cantilever support extends from the fixing point aft to a boom support adjacent a distal end and aft of an axle of the rear wheels. A boom is pivotably secured to the boom support at a boom pivot.

The frame may include a forward frame supporting the operator cab and an aft frame coupled with the forward frame at a coupling point. In this context, the pair of front wheels may be coupled with the forward frame, and the pair of rear wheels may be coupled with the aft frame. The cantilever support may extend from the fixing point aft beyond the coupling point to the boom support. The coupling point may include a frame pivot, where the forward frame may be pivotable relative to the aft frame via the frame pivot. The frame pivot is pivotable on a vertical axis such that the telehandler may be configured for articulated steering.

The boom may include an angled end adjacent the boom pivot. The boom may include a telescoping section or sections. The telehandler may further include an extendable actuator connected between the cantilever support and the boom. Still further, the telehandler may include a controller that receives data input with respect to a position of the forward frame relative to the aft frame, a position of the extendable actuator, an extension amount of the telescoping boom, and a load on the telescoping boom, where the controller may be programmed to control a position of the load based on the data input and manage a relationship between steering angle and boom position/load. The controller may be programmed to restrict at least one of boom displacement and a steering angle based on the load on the boom and a position of the boom The boom pivot may be aft of an axle of the rear wheels. The cantilever support may be oriented at an angle from a low position at the fixing point to a high position at the distal end. The boom support may be vertically spaced from the aft frame.

In another exemplary embodiment, an articulating telehandler includes a forward frame supporting an operator cab, front wheels coupled with the forward frame, an aft frame pivotably coupled with the forward frame at a frame pivot having a vertical axis, and rear wheels coupled with the aft frame. A cantilever support is secured at a fixing point to the forward frame and extends from the fixing point aft beyond the frame pivot to a boom support adjacent a distal end. A telescoping boom is pivotably secured at a boom pivot to the boom support.

In yet another exemplary embodiment, an articulating telehandler includes an articulated frame including a front frame segment and a rear frame segment separated by a frame pivot. A cantilever support extends from a fixing point on the front frame segment aft beyond the frame pivot to a boom support adjacent a distal end. A boom is pivotably secured at a boom pivot to the boom support. In this context, the boom may include at least one telescopic segment, and the telehandler further includes a drive system, a controller communicating with the drive system, a load sensor that measures a load on the boom, a boom position sensor that measures at least one of a boom height and a boom length, and a steering sensor that measures an angle between the front frame segment and the rear frame segment. The controller may receive input from the load sensor, the boom position sensor and the steering sensor. The controller may be programmed to restrict operation of the drive system based on the load on the boom, at least one of the boom height and the boom length, and the angle between the front frame segment and the rear frame segment.

BRIEF DESCRIPTION OF THE DRAWINGS

These and other aspects and advantages will be described in detail with reference to the accompanying drawings, in which.

DETAILED DESCRIPTION

Figure 1:
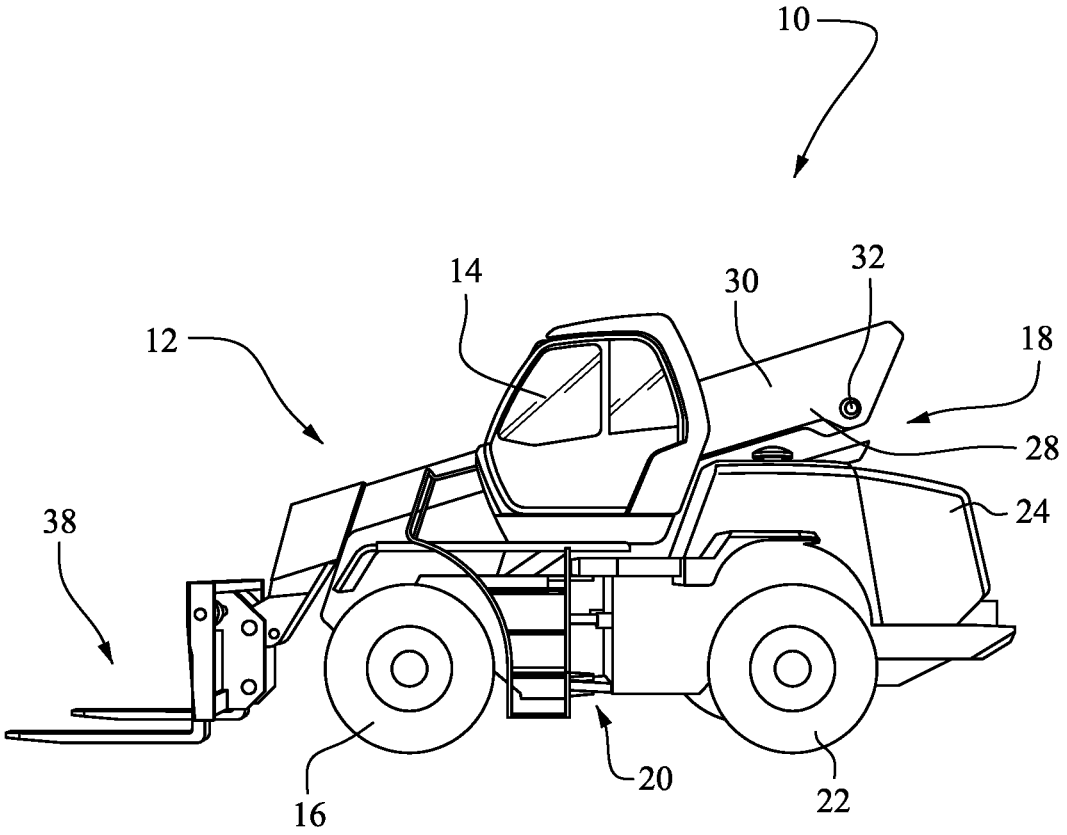
FIGS. 1 and 2 show exemplary configurations for the telehandler according to the described embodiments.
Figure 2:
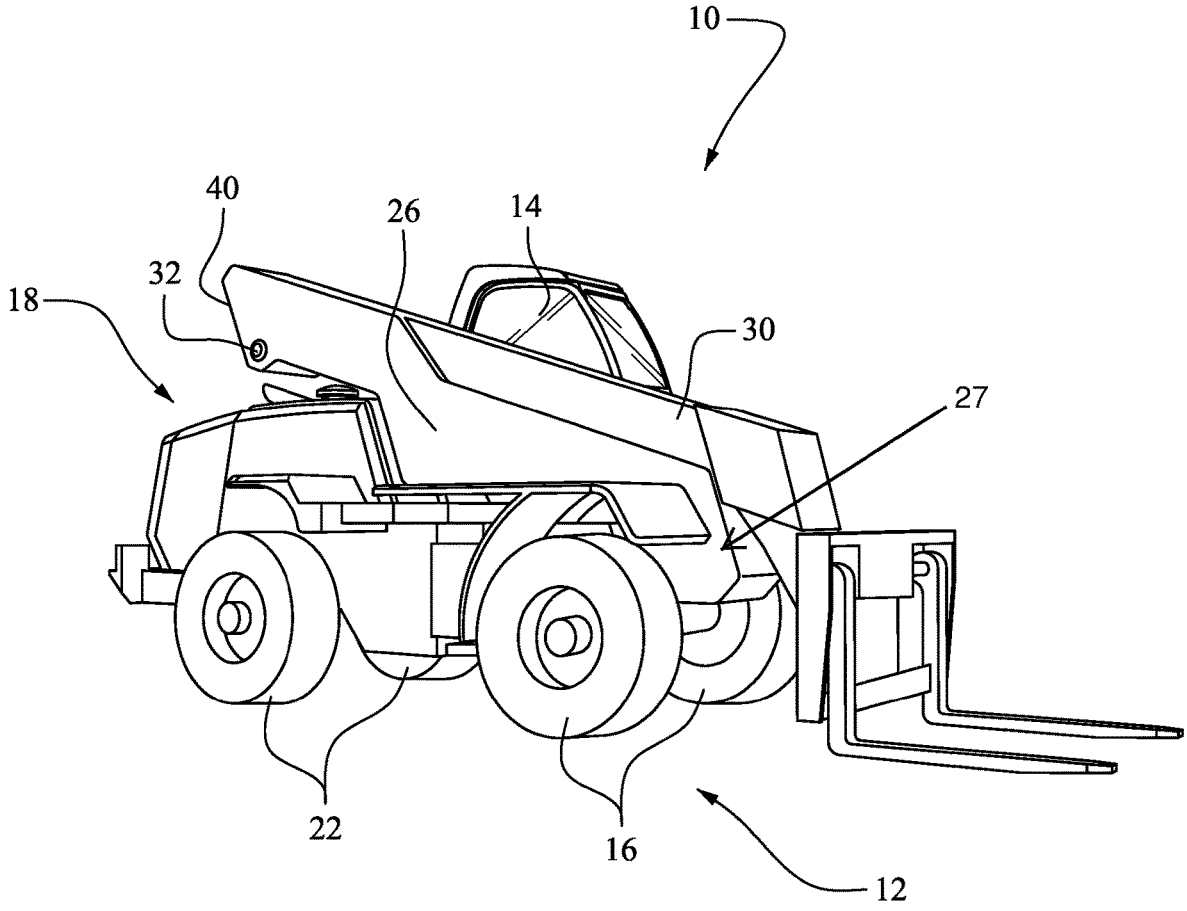

With reference to FIGS. 1 and 2, a telehandler 10 includes a forward frame 12 supporting an operator cab 14. The forward frame 12 is provided with a set of front wheels 16 for supporting the forward frame 12. An aft frame 18 is coupled with the forward frame 12 at a coupling point 20. The aft frame 18 is provided with a set of rear wheels 22 for supporting the aft frame 18. References to forward and aft directions as well as front and rear wheels are relative to a driving direction of the telehandler 10. A drive system including an engine and transmission drives one or both sets of wheels 16, 22. The drive system also includes control implements for positioning the boom/load and for steering. In the illustrated embodiment, driving components including the engine and transmission drive and the like are housed within an engine casing 24 that forms part of the aft frame 18.

In an exemplary embodiment, the coupling point 20 is a frame pivot such that the forward frame 12 is pivotable relative to the aft frame 18 via the frame pivot. Specifically, the coupling point or frame pivot 20 is pivotable on a vertical axis relative to a horizontal ground such that the telehandler 10 is configured for articulated steering. The frame pivot 20 may comprise a dual axis pivot including a horizontal axis pivot, so the rear frame can rotate in relation to the front frame to accommodate uneven terrain, and a vertical axis pivot for steering. In other embodiments, the center pivot has only a vertical axis pivot for steering, and the rear axle is mounted to the aft frame 18 via an axial pivot (oscillating axle design). As with conventional articulated steering vehicles, an actuator (not shown) pivots the forward and aft frames 12, 18 relative to one another to steer the telehandler 10. For example, an operator may steer the vehicle by manipulating a steering wheel or steering handle/joystick located in the cab 14. In some embodiments, the operator cab is equipped with both a steering wheel and a steering handle to command speed and direction of travel with an operator selector switch. Providing both gives the operator an option. Often, a steering wheel is preferred for longer, transport drives, whereas handle or joystick operation may be used during loading operations. Various drive arrangements may be employed for propelling the vehicle with the drive system in a two- or four-wheel drive configuration.

A cantilever support 26 is secured at a fixing point 27 to the forward frame 12. In some embodiments, the cantilever support 26 may be integral with the forward frame 12. The cantilever support 26 extends from the fixing point 27 aft beyond the coupling point 20 to a boom support 28 adjacent a distal end. As shown, in some embodiments, the cantilever support 26 is oriented at an angle from a low position at the fixing point 27 to a high position at the distal end. Additionally, in some embodiments, the boom support 28 is vertically spaced from the aft frame 18.

A boom 30 is pivotably secured to the boom support 28 at a boom pivot 32. The boom pivot 32 is aft of the coupling point/frame pivot 20 and in a preferred construction is aft of an axle 34 of the rear wheels 22. In this context, the distal end of the cantilever support 26 may thus similarly be positioned aft of the rear wheel axle 34 as shown. The forward frame 12 forms part of a forward section of the machine, which may include the forward frame 12, operator cab 14, front axle 35 and cantilever support 26. The aft frame 18 forms part of a rear section of the machine, which may include the aft frame 18, the engine (not shown), engine casing 24, engine hood, etc.

The boom 30 is preferably a telescoping boom that is extendable and retractable by a suitable actuator. A lifting actuator 36 is connected between the cantilever support 26 and/or the forward frame 12 and the boom 30. Extension of the lifting actuator 36 raises the boom 30 by pivoting the boom 30 on the boom pivot 32. A work implement 38 such as the fork carriage shown in the drawings is attached at a distal end of the boom 30. The manner of connecting the work implement 38 and controlling the work implement 38 during use are known and will not be further described.

Figure 3:
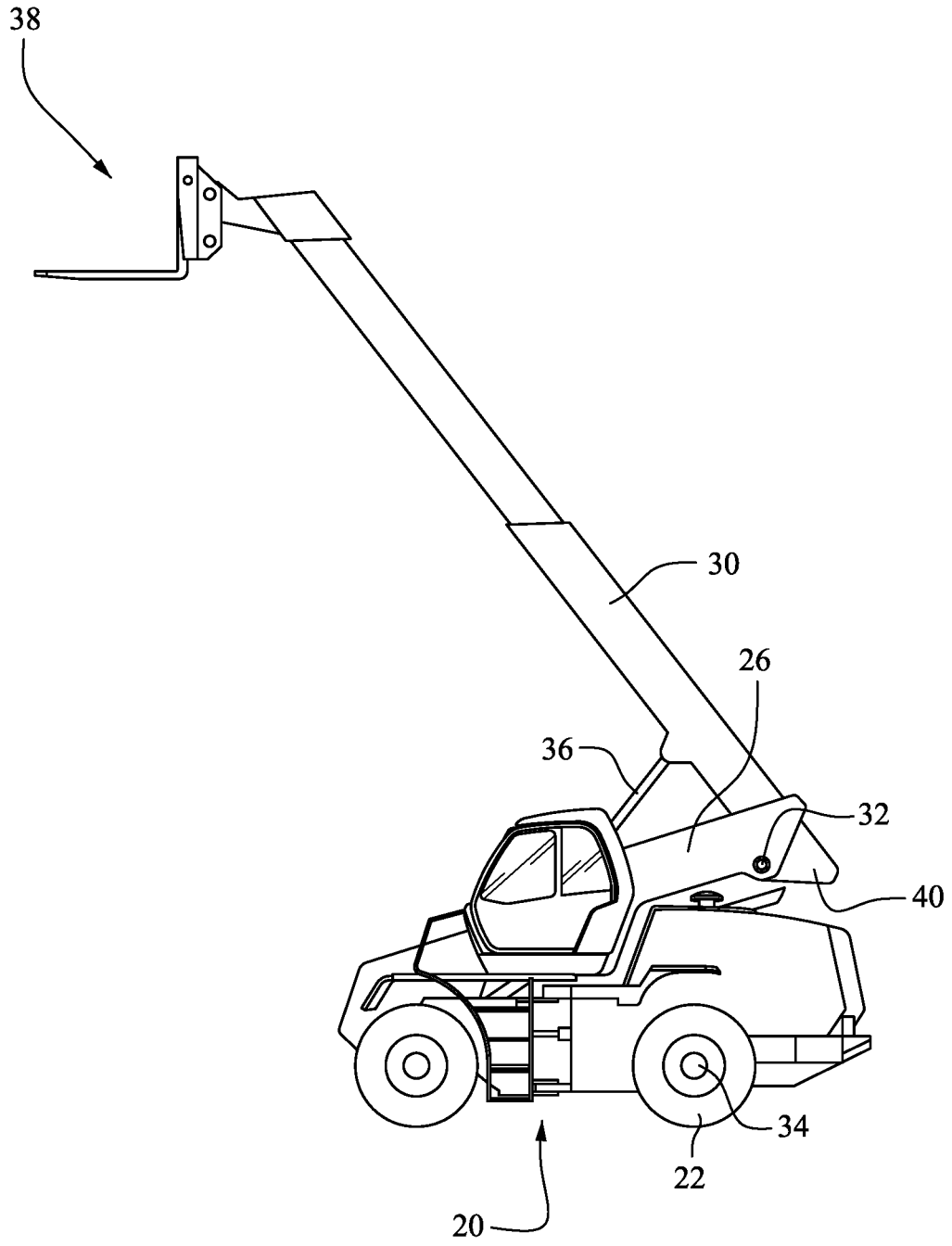
FIG. 3 shows the telehandler with the boom in a raised position.

In some embodiments, as shown in the drawings, the boom 30 includes an angled end 40 adjacent the boom pivot 32. As shown in FIG. 3, the angled end 40 serves to provide the boom 30 with an effective length that is beyond the boom pivot point 32. The angled end 40 enables the boom 30 to be raised without impacting the components mounted under the boom 30 or cantilever support 26 (see FIG. 3).

Figure 5:
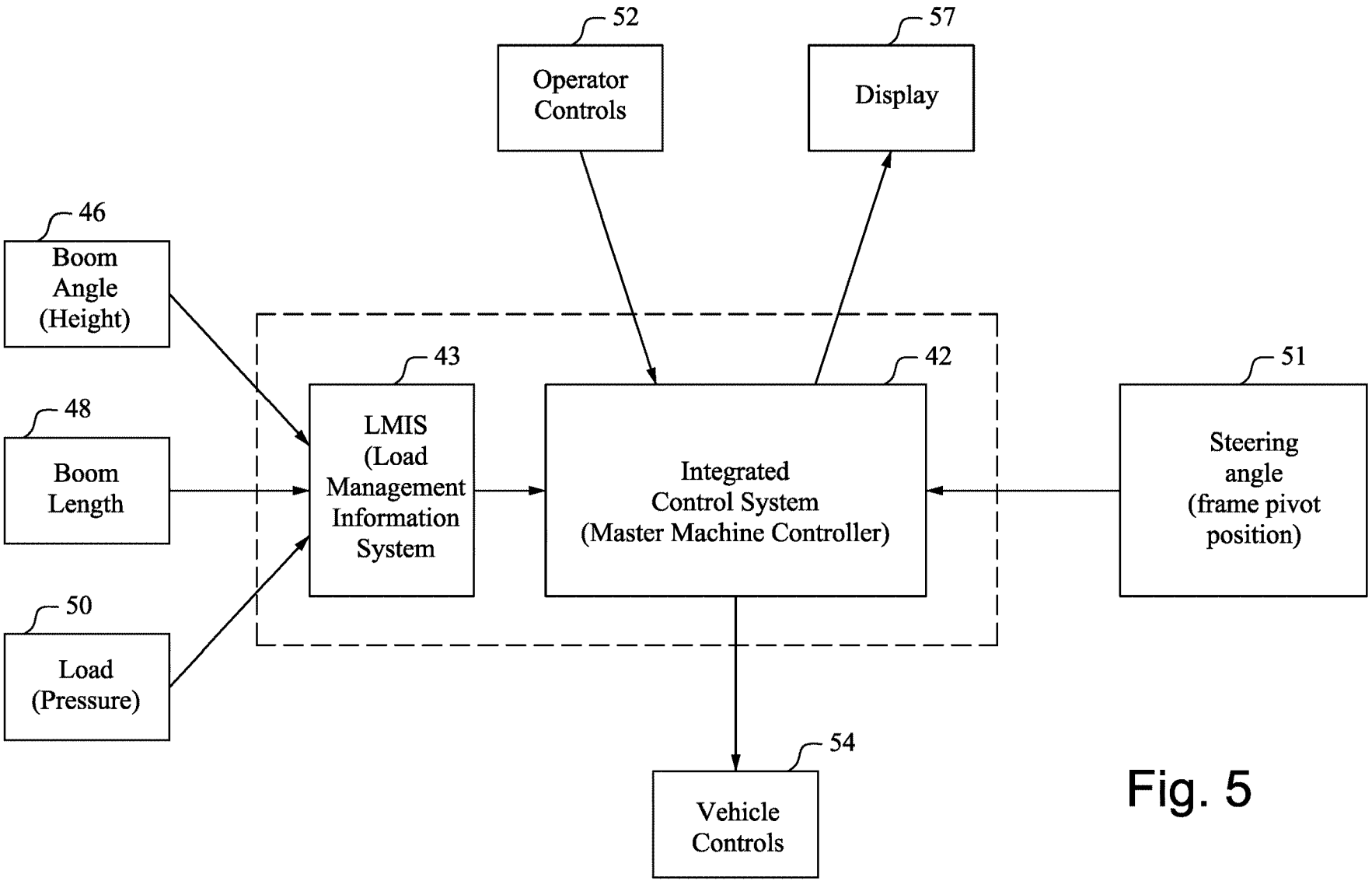
FIG. 5 is a schematic illustration showing operation of the controller.

The stability of the telehandler 10 may be managed by an electronic Integrated Control System (ICS) or Master Machine Controller (MMC). An exemplary ICS 42 is shown schematically in FIG. 5. The ICS 42 communicates with a load management indicator system (LMIS) module 43. Together, the ICS 42 and LMIS module 43 receive input from various sensors and signals from operator controls 52 that include steering wheel (or steering joystick) position information. The ICS 42 drives a display 57 that displays information to the operator, and the ICS 42 provides commands to vehicle controls 54 that include electrical controllers of hydraulic valves and the like.

The LMIS module 43 receives input from sensors that measure various structural characteristics and operating parameters of the machine related to loading conditions. For example, sensors may include a boom angle (indicating height) sensor 46, a boom length sensor 48, a load 50 on the boom, which can be established by measuring pressure in the hydraulic cylinders or measured directly. Knowing the load 50 and the position of the load via sensors 46 and 48, the LMIS module 43 can determine a load moment of the machine in relation to the boom pivot point 32. The LMIS module 43 and ICS 42 can be separate hardware devices or can be functional blocks of software incorporated into one hardware controller. Reference to a "controller" in the present specification is intended to encompass all control hardware and functionality including, without limitation, the ICS (or MMC) 42 and the LMIS module 43.

Figure 4:
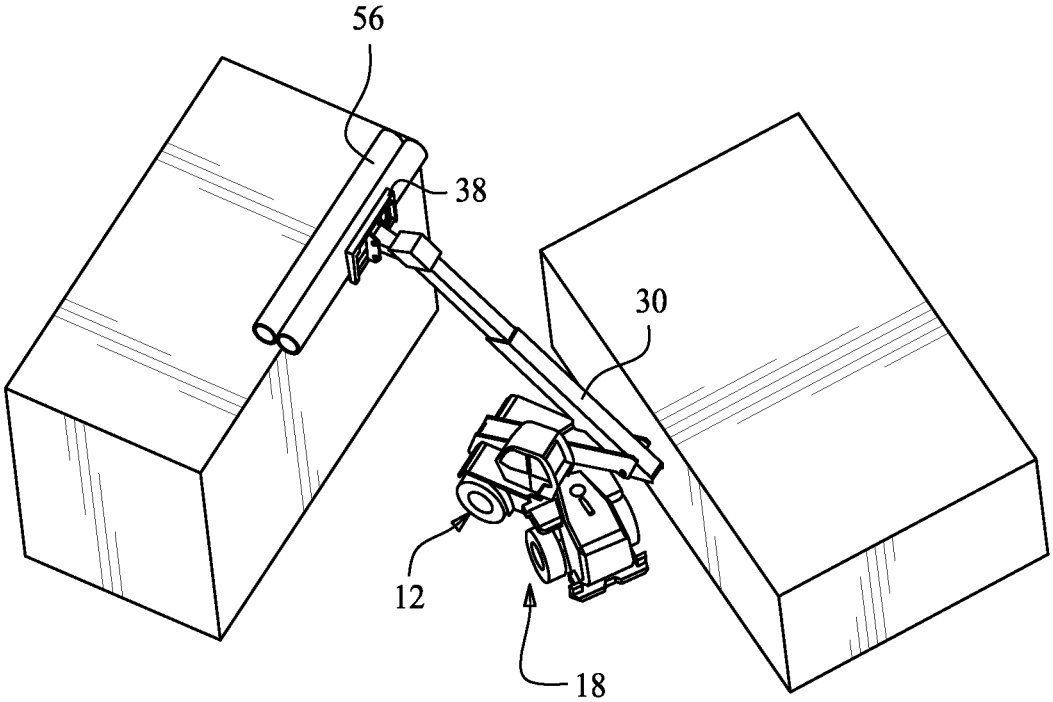
FIG. 4 shows the telehandler positioning a load.

For an articulated frame telehandler, the stabilizing moment of the machine depends on the position of the frame pivot (steering angle). A steering angle sensor 51 provides this information. Also, the position/manipulation of the operator controls 52 and the like is communicated to ICS 42, which processes the data from the various sensors 44-52 to control a position of the load and/or steering (frame pivot positions) by communicating with the vehicle controls 54. For example, with reference to FIG. 4, with the boom 30 in a raised and extended position, based on a relative angle of the front frame 12 to the aft frame 18 (steering angle), certain positions of the load 56 supported on the work implement 38 may cause the telehandler to become unstable, e.g., approaching a tipping condition. In the configuration shown in FIG. 4, if the operator attempts to move the load by steering function to the left (down in the figure), the position of the load 56 may cause the telehandler to become unstable. The controller prevents the operator from steering to move the load 56 to a position that could cause instability. In the orientation shown in FIG. 4, further steering to the left can be prohibited. The operator can resolve this situation by retracting the boom, lowering the boom and moving the machine closer to the building.

Different restrictions/permissions can be effected by the ICS 42 if the operator is travelling with the boom fully retracted and lowered and steers the machine to the high steering angle. In this case, the ICS 42 may prohibit (cut out) vehicle controls 54 allowing boom lift or extension based on information from the LMIS 43.

Figure 6:
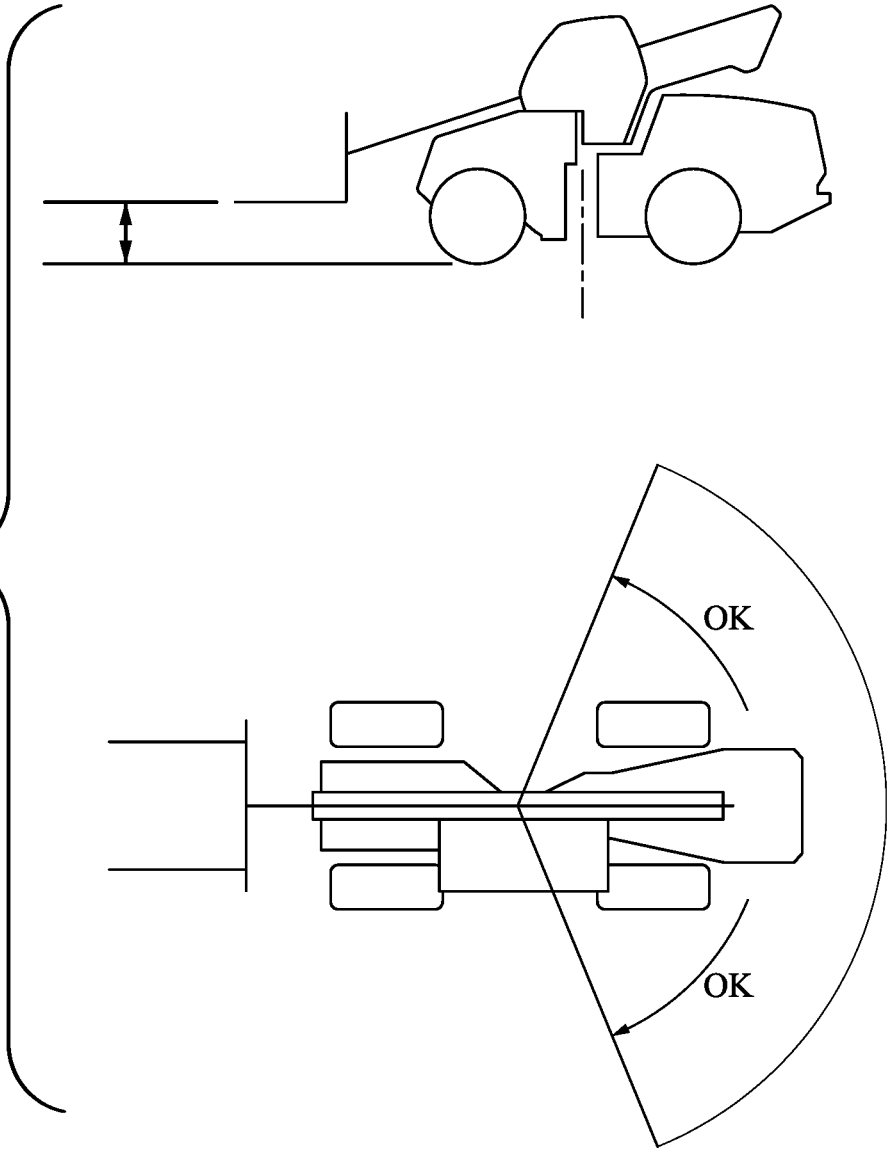
FIG. 6 is a schematic illustration of the telehandler with the boom in a transport position.
Figure 7:
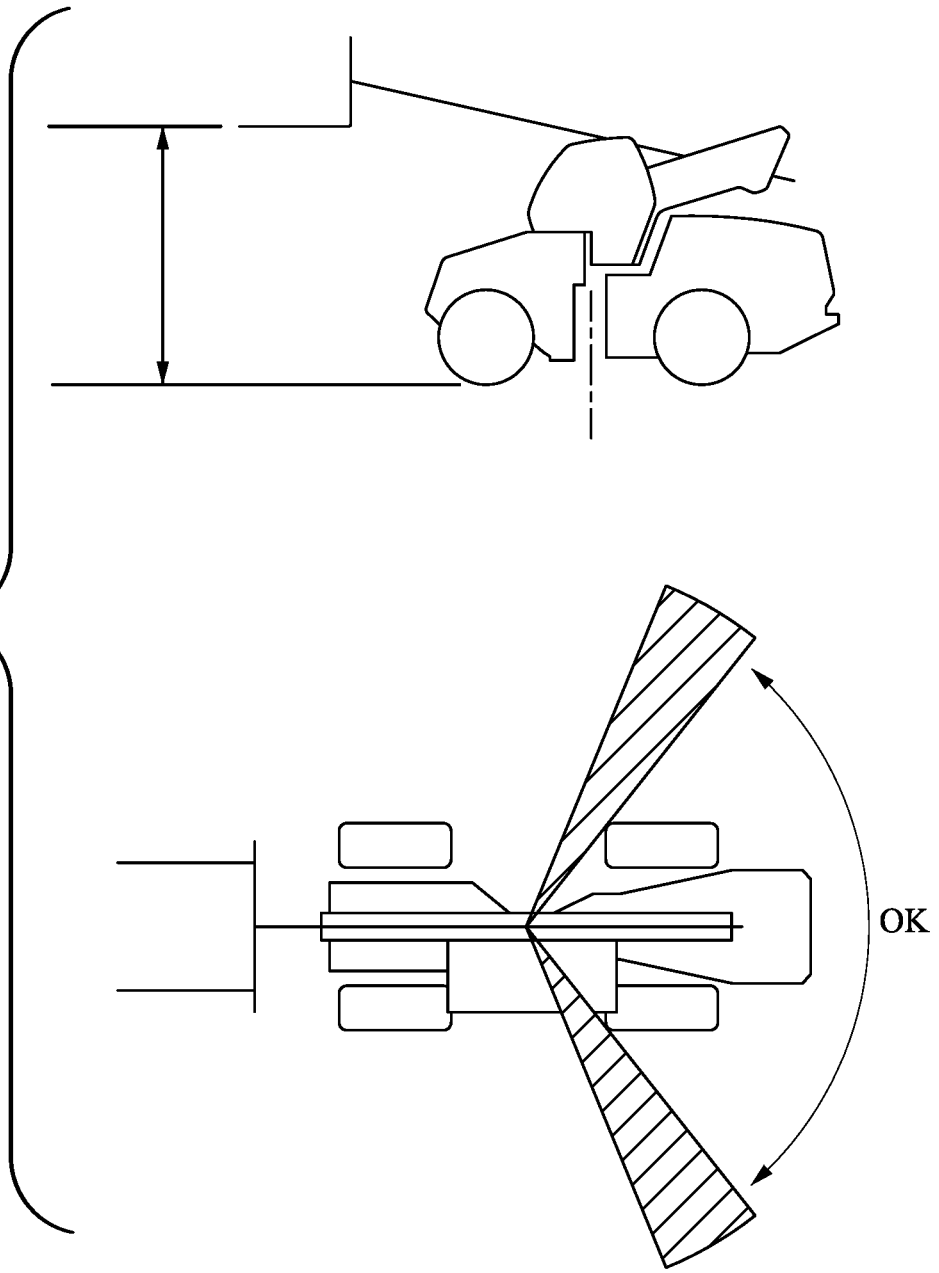
FIG. 7 is a schematic illustration of a condition restricting steering angle.
Figure 8:
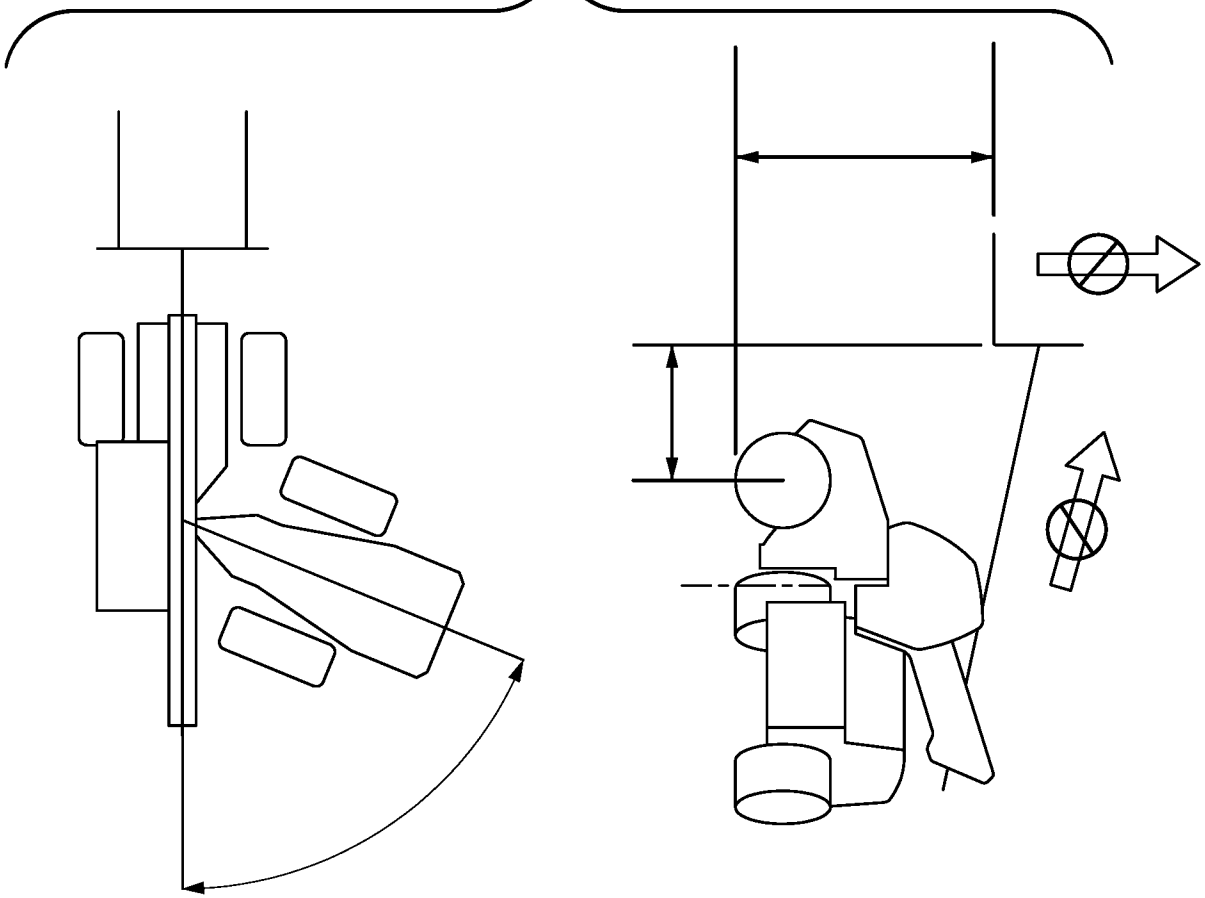
FIG. 8 is a schematic illustration of a condition restricting certain movement of the boom when the frame is pivoted (steered)

FIG. 6 shows that the machine can pick up the maximum rated load when the boom is fully retracted and the operating implement (such as the fork carriage shown) is close to the ground. The position shown in FIG. 6 is the position of load causing minimum instability moment. Maximum (rated) load is selected to allow full steering functionality (i.e., the ability to achieve any steering angle up to and including a maximum steering angle allowed by the articulated frame steering mechanism). Typically, the operator keeps the machine in this position for travel. When the operator moves the load from this transport position, several restrictions may occur—for example, if the machine is steered as shown schematically in FIG. 8, boom movement up/down or extension/retraction can be prohibited at a given, actual load measured by LMIS 43. If the boom is elevated and extended with a particular load, steering beyond an angle determined by ICS 42 can be restricted (prohibited) as shown in FIG. 7. Situations described above and illustrated in FIGS. 7 and 8 can happen only at low speeds, thereby providing the operator time to adjust to given restrictions and find a way to resolve them.

Figure 9:
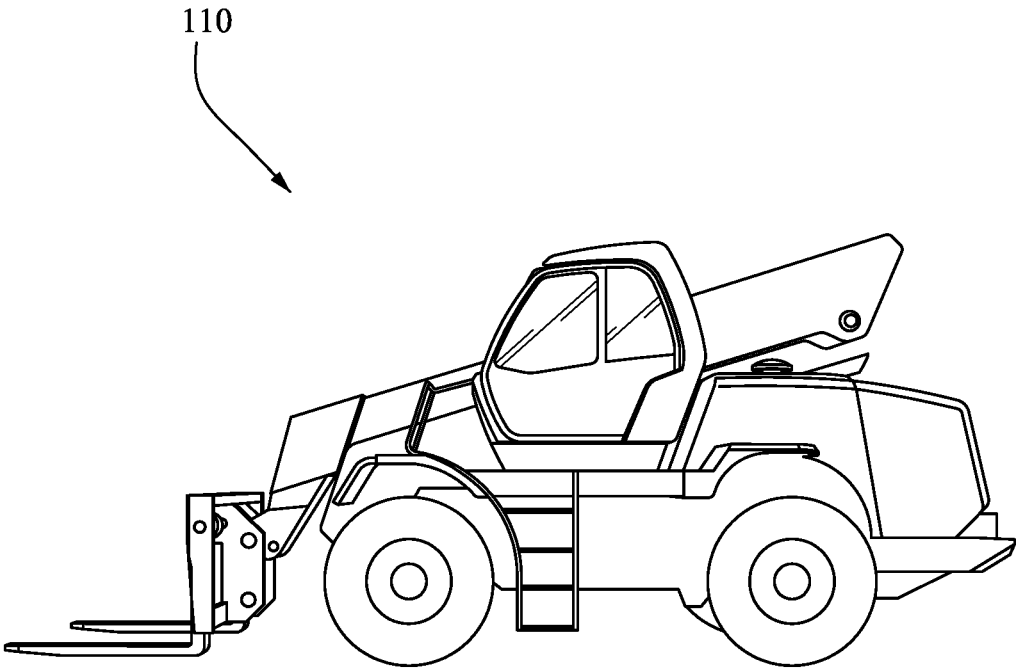
FIG. 9 shows an exemplary fixed frame telehandler.

The system can provide the operator with a warning or other graphic or the like to indicate why the vehicle is not responding to operator control requests. The graphics displayed on display 57 installed in the cab 14 can be similar to information shown in FIGS. 6-8 or can be designed in alternative ways to indicate which functions are allowed and which are prohibited FIG. 9 shows an exemplary fixed frame telehandler 110 with a cantilevered boom mount extending from the frame with a boom pivot point beyond rear axle and above the engine compartment. The fixed frame embodiment incorporates similar design features as the articulating frame embodiment(s) described above. The machine build along these lines would have better engine positioning than existing fixed frame designs where the engine is nested between frame sides and below the boom. The cantilevered boom support starts in front of the rear axle and extends to an area behind the rear axle and above the engine compartment. As shown, the engine is mounted below the cantilevered section angled end of the boom.

The described embodiments utilize a cantilever boom mounting to provide a stable telehandler with an extended reach. The cantilever boom mounting additionally provides for a telehandler with an articulated frame to facilitate vehicle and load positioning and to reduce a turning radius of the telehandler.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A telehandler comprising:

a frame supporting an operator cab and an engine casing;

a pair of front wheels and a pair of rear wheels coupled with the frame;

a cantilever support secured at a fixing point to the frame adjacent the front wheels, the cantilever support extending from the fixing point aft to a boom support adjacent a distal end and aft of an axle of the rear wheels; and a boom pivotably secured to the boom support at a boom pivot of the cantilever support, the boom pivot being spaced from and positioned directly above the engine casing, wherein the boom pivot is aft of the axle of the rear wheels.

2. A telehandler according to claim 1, wherein the frame comprises a forward frame supporting the operator cab and an aft frame coupled with the forward frame at a coupling point, wherein the pair of front wheels is coupled with the forward frame, and wherein the pair of rear wheels is coupled with the aft frame, the cantilever support extending from the fixing point aft beyond the coupling point to the boom support.

3. A telehandler according to claim 2, wherein the coupling point comprises a frame pivot, and wherein the forward frame is pivotable relative to the aft frame via the frame pivot.

4. A telehandler according to claim 3, wherein the frame pivot is pivotable on a vertical axis such that the telehandler is configured for articulated steering.

5. A telehandler according to claim 4, wherein the boom comprises a telescoping boom.

6. A telehandler according to claim 2, wherein the boom support is vertically spaced from the aft frame.

7. A telehandler according to claim 1, wherein the boom comprises an angled end adjacent the boom pivot.

8. A telehandler according to claim 1, wherein the boom comprises a telescoping boom.

9. A telehandler according to claim 8, further comprising an extendable actuator connected between the cantilever support and the boom, the extendable actuator being configured such that the extendable actuator is tilted aft at all raised positions of the boom.

10. A telehandler according to claim 9, further comprising a controller that receives data input with respect to a position of the forward frame relative to the aft frame, a position of the extendable actuator, an extension amount of the telescoping boom, and a load on the telescoping boom, wherein the controller is programmed to control a position of the load based on the data input.

11. A telehandler according to claim 1, wherein the cantilever support is oriented at an angle from a low position at the fixing point to a high position at the distal end.

12. A telehandler comprising:

a frame supporting an operator cab and an engine casing;

a pair of front wheels and a pair of rear wheels coupled with the frame;

a cantilever support secured at a fixing point to the frame, the cantilever support extending from the fixing point aft to a boom support adjacent a distal end and aft of an axle of the rear wheels;

a boom pivotably secured to the boom support at a boom pivot of the cantilever support, the boom pivot being spaced from and positioned vertically above the engine casing, wherein the frame comprises a forward frame supporting the operator cab and an aft frame coupled with the forward frame at a coupling point, wherein the pair of front wheels is coupled with the forward frame, and wherein the pair of rear wheels is coupled with the aft frame, the cantilever support extending from the fixing point aft beyond the coupling point to the boom support; and a controller that receives data input with respect to an angular position of the forward frame relative to the aft frame and a load on the boom, wherein the controller is programmed to control a position of the load based on the data input.

13. A telehandler according to claim 12, wherein the controller is programmed to restrict at least one of boom displacement and the angular position of the forward frame relative to the aft frame based on the load on the boom and a position of the boom.

14. An articulating telehandler comprising:

a forward frame supporting an operator cab and an engine casing;

front wheels coupled with the forward frame;

an aft frame pivotably coupled with the forward frame at a frame pivot having a vertical axis;

rear wheels coupled with the aft frame;

a cantilever support secured at a fixing point to the forward frame adjacent the front wheels, the cantilever support extending from the fixing point aft and beyond an axle of the rear wheels to a boom support adjacent a distal end; and a telescoping boom pivotably secured at a boom pivot to the boom support, the boom pivot being spaced from and positioned directly above the engine casing, wherein the boom pivot is aft of the axle of the rear wheels.

15. An articulating telehandler according to claim 14, wherein the telescoping boom comprises an angled end adjacent the boom pivot.

16. An articulating telehandler according to claim 14, further comprising an extendable actuator connected between the cantilever support and the telescoping boom.

17. An articulating telehandler according to claim 16, further comprising a controller that receives data input with respect to an angular position of the forward frame relative to the aft frame, a position of the extendable actuator, an extension amount of the telescoping boom, and a load on the telescoping boom, wherein the controller is programmed to control a position of the load based on the data input.

18. An articulating telehandler according to claim 17, wherein the controller is programmed to control the position of the load based on the data input only at low speeds.

19. An articulating telehandler according to claim 17, wherein the controller is programmed to indicate load positioning limitations on a graphic display.

20. An articulating telehandler according to claim 14, wherein the cantilever support is oriented at an angle from a low position at the fixing point to a high position at the distal end.

21. An articulating telehandler according to claim 20, wherein the boom support is vertically spaced from the aft frame.

22. An articulating telehandler comprising:

an articulated frame including a front frame segment and a rear frame segment separated by a frame pivot;

a cantilever support extending from a fixing point on the front frame segment aft beyond the frame pivot to a boom support adjacent a distal end; and a boom pivotably secured at a boom pivot to the boom support, the boom pivot being aft of the rear wheels;

wherein the boom comprises at least one telescopic segment, the articulating telehandler further comprising:

a drive system;

a controller communicating with the drive system;

a load sensor that measures a load on the boom;

a boom position sensor that measures at least one of a boom height and a boom length; and a steering sensor that measures an angle between the front frame segment and the rear frame segment, wherein the controller receives input from the load sensor, the boom position sensor and the steering sensor, and wherein the controller is programmed to restrict operation of the drive system based on the load on the boom, at least one of the boom height and the boom length, and the angle between the front frame segment and the rear frame segment.

* * * * *